US008939528B2

(12) United States Patent
Yamanobe

(10) Patent No.: US 8,939,528 B2
(45) Date of Patent: Jan. 27, 2015

(54) INKJET PRINTING APPARATUS AND INKJET PRINTING METHOD

(75) Inventor: Jun Yamanobe, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 957 days.

(21) Appl. No.: 13/004,071

(22) Filed: Jan. 11, 2011

(65) Prior Publication Data

US 2011/0193902 A1 Aug. 11, 2011

(30) Foreign Application Priority Data

Feb. 10, 2010 (JP) ..... 2010-027954

(51) Int. Cl.

| | |
|---|---|
| ***B41J 29/38*** | (2006.01) |
| ***B41J 2/17*** | (2006.01) |
| ***B41J 2/21*** | (2006.01) |
| ***B41J 3/60*** | (2006.01) |
| ***B41J 11/00*** | (2006.01) |

(52) U.S. Cl.

CPC ..... *B41J 29/38* (2013.01); *B41J 2/2114* (2013.01); *B41J 3/60* (2013.01); *B41J 11/0015* (2013.01)

USPC ..... 347/9; 347/96

(58) Field of Classification Search

USPC ..... 347/9

See application file for complete search history.

(56) References Cited

U.S. PATENT DOCUMENTS

| | | | |
|---|---|---|---|
| 2003/0218656 | A1 | 11/2003 | Yamazaki et al. |
| 2009/0291215 | A1 | 11/2009 | Makuta et al. |

FOREIGN PATENT DOCUMENTS

| | | | | |
|---|---|---|---|---|
| JP | 2004-58308 | A | 2/2004 | |
| JP | 2004-90323 | A | 3/2004 | |
| JP | 2006-76129 | A | 3/2006 | |
| JP | 2007-313718 | A | 12/2007 | |
| JP | 2008-188947 | A | 8/2008 | |
| JP | 2008-290286 | A | 12/2008 | |
| JP | 2008290286 | * | 12/2008 | ..... B41J 2/01 |
| JP | 2009-279870 | A | 12/2009 | |
| JP | 2010-5857 | A | 1/2010 | |

OTHER PUBLICATIONS

Japanese Office Action ("Decision on the Dismissal of Amendments") issued Dec. 17, 2013.

Japanese Office Action, dated Sep. 27, 2013, for Japanese Application No. 2010-027954.

* cited by examiner

*Primary Examiner* — Michelle R Connelly
*Assistant Examiner* — Kajli Prince
(74) *Attorney, Agent, or Firm* — Birch, Stewart, Kolasch & Stewart, LLP

(57) ABSTRACT

An inkjet printing apparatus includes: a conveyance device which conveys paper; an inkjet head which ejecting droplets of colored ink onto the paper conveyed by the conveyance device so as to form an image on the paper; a transparent liquid deposition device which deposits a transparent liquid onto a blank background portion of the paper conveyed by the conveyance device; a transparent liquid deposition volume determination device which determines a deposition volume of the transparent liquid to be deposited onto the paper, according to printing information that is required for printing the image on the paper; and a transparent liquid deposition control device which controls the transparent liquid deposition device in such a manner that the transparent liquid with the deposition volume determined by the transparent liquid deposition volume determination device is deposited onto the blank background portion of the paper.

10 Claims, 4 Drawing Sheets

| | PENDING | NOT PENDING |
|---|---|---|
| REAR SURFACE PRINTING | 1 | 0.3 |

| | COATED PAPER | NORMAL PAPER |
|---|---|---|
| THICK PAPER (150 gsm OR ABOVE) | 0 | 0 |
| THIN PAPER (LESS THAN 150 gsm) | 0.5 | 1 |

| | PENDING | NOT PENDING |
|---|---|---|
| REAR SURFACE PRINTING | 1 | 0.3 |

| | LOW SPEED | HIGH SPEED |
|---|---|---|
| PRINTING SPEED | 1 | 0.3 |

FIG.7

| MAXIMUM VALUE Vmax OF REGION INK VOLUMES | THRESHOLD VALUE |
|---|---|
| Vmax ≤ 0.4 | 0.2 |
| 0.4 < Vmax ≤ 0.6 | 0.25 |
| 0.6 < Vmax ≤ 0.8 | 0.35 |
| 0.8 < Vmax ≤ 1.0 | 0.45 |

INKJET PRINTING APPARATUS AND INKJET PRINTING METHOD

BACKGROUND OF THE INVENTION

1. Field of the Invention

The present invention relates to an inkjet printing apparatus and an inkjet printing method, and more particularly to an inkjet printing apparatus and an inkjet printing method of printing by depositing a transparent liquid onto a blank background portion.

2. Description of the Related Art

If an aqueous ink (ink containing water as a solvent) is used for printing by an inkjet method onto general printing paper, then there is a possibility that the portion where ink has been deposited deforms (producing curl, cockling, etc.) due to the solvent (principally, water), and hence the quality of the printed object is impaired. Furthermore, even if there is slight deformation which does not affect quality, in the case of a system where paper is conveyed by suctioning (for example, a system where the paper is conveyed on a drum or on a belt), there is a possibility that the deformation of the paper will accumulate if the paper is progressively suctioned from the leading end thereof and wrinkles will occur in the trailing end portion thereof.

Japanese Patent Application Publication No. 2004-58308 and Japanese Patent Application Publication No. 2008-290286 propose equalizing the amount of moisture in an entire sheet of paper and thereby eliminating local deformation of the paper, by depositing a transparent liquid onto blank background portions (non-image portions) of the paper.

However, according to the technology in Japanese Patent Application Publication No. 2004-58308 and Japanese Patent Application Publication No. 2008-290286, blank background portions are determined from a printed image, and a transparent liquid is simply deposited onto the blank background portions thus determined, and therefore the transparent liquid is deposited even if there is essentially no need to deposit the transparent liquid, thus leading to increased costs.

SUMMARY OF THE INVENTION

The present invention has been contrived in view of these circumstances, an object thereof being to provide an inkjet recording apparatus and an inkjet recording method whereby printing can be performed by depositing a transparent liquid appropriately onto paper, to neither an excessive nor an insufficient degree.

In order to attain an object described above, one aspect of the present invention is directed to an inkjet printing apparatus comprising: a conveyance device which conveys paper; an inkjet head which ejecting droplets of colored ink onto the paper conveyed by the conveyance device so as to form an image on the paper; a transparent liquid deposition device which deposits a transparent liquid onto a blank background portion of the paper conveyed by the conveyance device; a transparent liquid deposition volume determination device which determines a deposition volume of the transparent liquid to be deposited onto the paper, according to printing information that is required for printing the image on the paper; and a transparent liquid deposition control device which controls the transparent liquid deposition device in such a manner that the transparent liquid with the deposition volume determined by the transparent liquid deposition volume determination device is deposited onto the blank background portion of the paper.

According to this aspect of the invention, a deposition volume of transparent liquid (including substantially transparent liquid) to be deposited on the blank background portion of paper is determined on the basis of prescribed printing information which is required for printing. By this means, it is possible to deposit transparent liquid onto the paper appropriately, to neither an excessive nor an insufficient degree.

Desirably, the printing information is information about the paper.

According to this aspect of the invention, the transparent liquid deposition volume to be deposited on the blank background portion of the paper is determined on the basis of information about the paper used. The extent of deformation of the paper when transparent liquid is deposited varies with the paper, and therefore it is possible to deposit transparent liquid appropriately by determining the transparent liquid deposition volume in accordance with the paper used.

Desirably, the information about the paper is information on at least one of a type of the paper and thickness of the paper.

According to this aspect of the invention, the transparent liquid deposition volume to be deposited on the blank background portion of the paper is determined on the basis of information about the type and thickness of paper used. The extent of deformation of the paper when transparent liquid is deposited varies with the type of paper (the presence or absence of a coating layer, etc.), and therefore it is possible to deposit transparent liquid appropriately by determining the transparent liquid deposition volume in accordance with the type of paper used. Furthermore, even with paper of the same type, the extent of deformation also varies with the paper thickness, and therefore it is possible to deposit transparent liquid appropriately by determining the transparent liquid deposition volume in accordance with the thickness of the paper used.

Desirably, the printing information is information about whether rear surface printing is performed onto the paper or not.

According to the present invention, the transparent liquid deposition volume to be deposited on the blank background portion of the paper is determined on the basis of information about the presence or absence of printing onto the rear surface. Furthermore, even if there is slight deformation which does not affect quality, in the case of a system where paper is conveyed by suctioning (for example, a system where the paper is conveyed on a drum or on a belt), the deformation of the paper could accumulate if the paper is progressively suctioned from the leading end thereof and wrinkles could occur in the trailing end portion of the paper. Consequently, if rear side printing is pending, then the deposition volume of the transparent liquid is increased to remove local distortion of the paper. By this means, it is possible to deposit the transparent liquid appropriately.

Desirably, the printing information is information about a speed of printing onto the paper.

According to this aspect of the invention, the transparent liquid deposition volume to be deposited on the blank background portion of the paper is determined on the basis of information about the printing speed (the conveyance speed of the paper during printing). Normally, paper is supplied to drying after ink has been deposited. If the printing speed is fast, then the time until drying is short, and the paper can be supplied to drying before permeation of the solvent has progressed. In other words, it is possible to dry the solvent before deformation progresses. Consequently, if the printing speed is fast, then the deposition volume of transparent liquid is reduced. By this means, it is possible to deposit the transparent liquid appropriately.

Desirably, the printing information is information about the image to be printed onto the paper.

According to this aspect of the invention, the transparent liquid deposition volume to be deposited on the blank background portion of the paper is determined on the basis of information about an image to be printed on the paper. Local deformation of the paper occurs due to the difference between the portions where ink has been deposited and the portions where ink has not been deposited. Portions of the paper which will receive the deposition of ink are determined on the basis of the image. Consequently, by determining the transparent liquid deposition volume in accordance with the image, it is possible to deposit the transparent liquid appropriately.

Desirably, the transparent liquid deposition volume determination device divides a print area of the paper into a plurality of regions, calculates a volume of the ink to be deposited onto each of the plurality of regions as a region ink volume, from the information about the image to be printed on the paper, and determines the deposition volume of the transparent liquid to be deposited onto each of the plurality of regions according to information about the region ink volume thus obtained.

According to this aspect of the invention, the print area of the paper is divided into a plurality of regions, and the transparent liquid deposition volume to be deposited on each region is determined on the basis of information about the volume of ink deposited on each of the divided regions. By this means, it is possible to deposit the transparent liquid appropriately.

Desirably, the transparent liquid deposition volume determination device compares the region ink volume of each of the plurality of regions with a threshold value, and sets the deposition volume of the transparent liquid to be deposited onto a region where the region ink volume is equal to or greater than the threshold value, to zero.

According to this aspect of the invention, transparent liquid is deposited only onto a region where the region ink volume is lower than a threshold value. By this means, it is possible to deposit the transparent liquid appropriately onto each region.

Desirably, the threshold value is set in accordance with a maximum value of the region ink volume.

According to this aspect of the invention, the threshold value is switched in accordance with the maximum value of the region ink volumes. By this means, it is possible to deposit the transparent liquid appropriately onto each region.

Desirably, the printing information includes at least one of information about the paper, information about whether rear surface printing is performed onto the paper or not, information about a speed of printing onto the paper and information about the image to be printed on the paper.

According to this aspect of the invention, the transparent liquid deposition volume to be deposited onto the blank background portion of the paper is determined on the basis of at least one of information about the paper, information about the presence or absence of rear surface printing onto the paper, information about the printing speed onto the paper, and information about the image to be printed on the paper. More specifically, the transparent liquid deposition volume is determined on the basis of a plurality of conditions. By this means, it is possible to deposit the transparent liquid more appropriately.

Desirably, each of the transparent liquid and the ink includes at least water and an organic solvent as a component; and $SP1>SP2$ is established, where $SP1$ represents a solubility parameter of the organic solvent in the transparent liquid and $SP2$ represents a solubility parameter of the organic solvent in the ink.

According to this aspect of the invention, as well as forming an image by an ink containing at least water and an organic solvent, a transparent liquid containing at least water and an organic solvent is deposited onto the blank background portion. The transparent liquid deposited onto the blank background portion of the paper is a transparent liquid containing an organic solvent having higher polarity than the organic solvent contained in the ink (in other words, an organic solvent having a higher solubility parameter (SP)). By this means, it is possible to spread the liquid using a smaller amount.

Desirably, $\gamma 1<\gamma 2$ is established, where $\gamma 1$ represents a surface tension of the transparent liquid and $\gamma 2$ represents a surface tension of the ink.

According to this aspect of the invention, transparent liquid is deposited on the blank background portion of the paper using a transparent liquid having lower surface tension than the surface tension of the ink. By this means, the transparent liquid can permeate into the paper more rapidly than the ink and as a result of this can be spread over the paper using a smaller volume.

Desirably, $\eta 1<\eta 2$ is established, where $\eta 1$ represents viscosity of the transparent liquid and $\eta 2$ represents viscosity of the ink.

According to this aspect of the invention, transparent liquid is deposited on the blank background portion of the paper using a transparent liquid having lower viscosity than the viscosity of the ink. By this means, the transparent liquid can permeate into the paper more rapidly than the ink and as a result of this can be spread over the paper using a smaller volume.

In order to attain another object described above, one aspect of the present invention is directed to an inkjet printing method of printing an image, comprising the steps of: depositing droplets of colored ink by an inkjet head onto paper conveyed by a conveyance device so as to form the image on the paper; and depositing transparent liquid by a transparent liquid deposition device onto a blank background portion of the paper, wherein a deposition volume of the transparent liquid to be deposited onto the paper is determined according to printing information that is required for printing the image onto the paper.

According to this aspect of the invention, a deposition volume of transparent liquid (including substantially transparent liquid) to be deposited on the blank background portion of paper is determined on the basis of prescribed printing information which is required for printing. By this means, it is possible to deposit transparent liquid onto the paper appropriately, to neither an excessive nor an insufficient degree.

Desirably, the printing information includes at least one of information about the paper, information about whether rear surface printing is performed onto the paper or not, information about a speed of printing onto the paper and information about the image to be printed on the paper.

According to this aspect of the invention, the transparent liquid deposition volume to be deposited onto the blank background portion of paper is determined on the basis of at least one of information about the paper, information about the presence or absence of rear surface printing onto the paper, information about the printing speed onto the paper, and information about the image to be printed on the paper. By this means, it is possible to deposit the transparent liquid more appropriately.

According to the present invention, it is possible to print onto paper by depositing transparent liquid appropriately, to neither an excessive nor an insufficient degree.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein:

FIG. 7 is a table showing the relationship between the maximum value (Vmax) of region ink volumes and the threshold value.

DESCRIPTION OF THE PREFERRED EMBODIMENTS

General Composition

Figure 1:
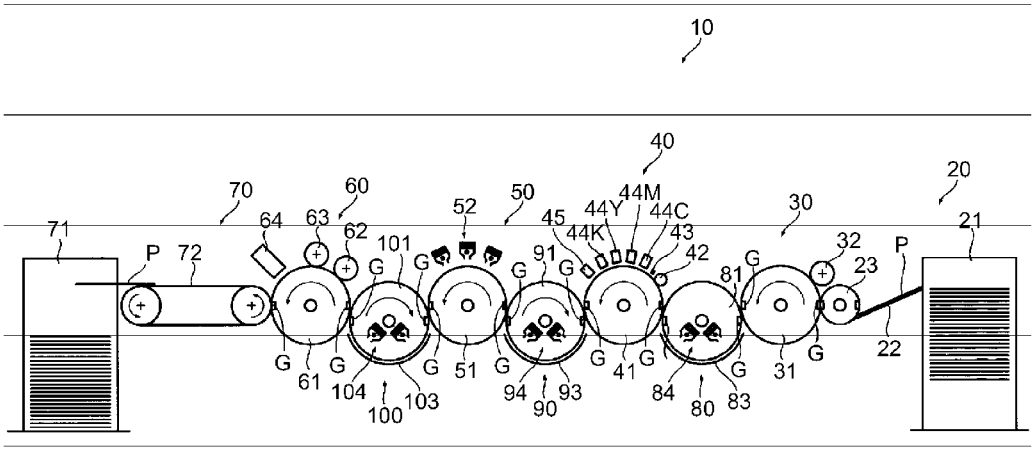
FIG. 1 is a schematic drawing showing the general composition of an inkjet printing apparatus.

FIG. 1 is schematic drawing showing the general composition of an inkjet printing apparatus according to one embodiment of the present invention.

The inkjet printing apparatus 10 shown in FIG. 1 is a printing apparatus which performs printing by an inkjet method onto cut sheet paper P, using an aqueous ink (ink including water in the solvent), and includes a paper supply unit 20 which supplies paper P, a treatment liquid deposition unit 30 which deposits a prescribed treatment liquid onto a printing surface of the paper P, an image recording unit 40 which ejects droplets of ink of the respective colors of C (cyan), M (magenta), Y (yellow) and K (black) onto a printing surface of the paper P, from an inkjet head, so as to form a color image, an ink drying unit 50 which dries the ink droplets that have been ejected onto the paper P, a fixing unit 60 which fixes the image recorded on the paper P, and a recovery unit 70 which recovers paper P.

Conveyance drums 31, 41, 51, 61 are provided respectively as conveyance devices of the paper P, in the treatment liquid deposition unit 30, the image recording unit 40, the ink drying unit 50 and the fixing unit 60. The paper P is conveyed through the treatment liquid deposition unit 30, the image recording unit 40, the ink drying unit 50 and the fixing unit 60, by means of these conveyance drums 31, 41, 51 and 61.

The conveyance drums 31, 41, 51, 61 are formed to correspond to the paper width and rotate by being driven by motors (not illustrated) (in FIG. 1, the drums rotate in the counterclockwise direction). Grippers G are provided on the circumferential surface of each conveyance drum 31, 41, 51, 61, and the paper P is conveyed with the leading end portion thereof being gripped by a gripper G. In the present embodiment, a composition is adopted in which grippers G are provided at two positions (separated by 180°) on the circumferential surface of each conveyance drum 31, 41, 51, 61, in such a manner that two sheets of paper can be conveyed in one revolution.

Moreover, a lot of suction holes are formed in the circumferential surface of each of the conveyance drums 31, 41, 51 and 61, and the rear surface of the paper P is vacuum suctioned via these suction holes, thereby holding the paper P by suction on the circumferential surfaces of the conveyance drums 31, 41, 51, 61. In the present embodiment, a composition is adopted in which the paper P is vacuum suctioned and held by suction on the outer circumferential surfaces of the conveyance drums 31, 41, 51, 61, but it is also possible to adopt a composition in which the paper P is attracted electrostatically and held by electrostatic attraction on the outer circumferential surfaces of the conveyance drums 31, 41, 51, 61.

Transfer drums 80, 90, 100 are disposed respectively between the treatment liquid deposition unit 30 and the image recording unit 40, between the image recording unit 40 and the ink drying unit 50, and between the ink drying unit 50 and the fixing unit 60. The paper P is conveyed between the respective units by means of these transfer drums 80, 90, 100.

The transfer drums 80, 90, 100 are composed by transfer drum main bodies 81, 91, 101 constituted by frames, and grippers G which are provided on the transfer drum main bodies 81, 91, 101. The transfer drum main bodies 81, 91, 101 are formed to correspond to the paper width and rotate by being driven by motors (not illustrated) (in FIG. 1, the drums rotate in the clockwise direction). By this means, the grippers G rotate on the same circular path. The paper P is conveyed with the leading end portion thereof being gripped by a gripper G. In the present embodiment, a pair of grippers G is arranged at symmetrical positions about the axis of rotation, in such a manner that two sheets of paper can be conveyed in one revolution.

Circular arc-shaped guide plates 83, 93, 103 are arranged along the conveyance path of the paper P, below the transfer drums 80, 90, 100 respectively. The paper P which is conveyed by the transfer drums 80, 90, 100 is conveyed while the rear surface of the paper (the surface on the opposite side to the printing surface) is guided by the guide plates 83, 93 and 103.

Furthermore, driers 84, 94, 104 which blow a hot air flow toward the guide plates 83, 93, 103 are arranged inside the transfer drums 80, 90, 100 respectively. The hot air flows blown out from the driers 84, 94, 104 during this conveyance process strike the printing surface of the paper P conveyed by the transfer drums 80, 90 and 100.

The paper P supplied from the paper supply unit 20 is transferred to the conveyance drum 31 of the treatment liquid deposition unit 30, and is then transferred from the conveyance drum 31 of the treatment liquid deposition unit 30 to the conveyance drum 41 of the image recording unit 40 via the transfer drum 80. The paper P is transferred from the conveyance drum 41 of the image recording unit 40 to the conveyance drum 51 of the ink drying unit 50 via the transfer drum 90, and is transferred from the conveyance drum 51 of the ink drying unit 50 to the conveyance drum 61 of the fixing unit 60 via the transfer drum 100. The paper is then transferred from the conveyance drum 61 of the fixing unit 60 to the recovery unit 70. While the paper P passes through this series of conveyance steps, required processes are carried out and an image is formed on the printing surface of the paper P.

The paper P is conveyed in such a manner that the printing surface is facing toward the outside on the conveyance drums 31, 41, 51, 61, and the printing surface is facing toward the inside on the transfer drums 80, 90 and 100.

The composition of the respective units of the inkjet printing apparatus 10 according to the present embodiment is described in detail below.

Paper Supply Unit

The paper supply unit 20 includes a paper supply apparatus 21, a paper supply tray 22 and a transfer drum 23, and supplies cut sheet paper P continuously, one sheet at a time, to the treatment liquid deposition unit 30.

The paper supply apparatus 21 supplies paper P stacked in a magazine (not illustrated), successively, one sheet at a time from the upper side, to the paper supply tray 22.

The paper supply tray 22 outputs the paper P supplied from the paper supply apparatus 21, to the transfer drum 23.

The transfer drum 23 receives the paper P output from the paper supply tray 22, conveys the paper along a prescribed conveyance path, and then transfers the paper to the conveyance drum 31 of the treatment liquid deposition unit 30.

Treatment Liquid Deposition Unit

The treatment liquid deposition unit 30 deposits a prescribed treatment liquid onto the printing surface of the paper P. The treatment liquid deposition unit 30 includes a conveyance drum which conveys the paper P (called "treatment liquid deposition drum" below) 31, and a treatment liquid deposition apparatus 32 which deposits a prescribed treatment liquid onto the printing surface of the paper P conveyed by the treatment liquid deposition drum 31.

The treatment liquid deposition drum 31 receives paper P from the transfer drum 23 of the paper supply unit 20 (by gripping the leading end of the paper P with a gripper G), and conveys the paper P by rotating.

The treatment liquid deposition apparatus 32 deposits treatment liquid having a function of aggregating the coloring material in the ink, onto the printing surface of the paper P conveyed by the treatment liquid deposition drum 31. In the inkjet printing apparatus 10 according to the present embodiment, the treatment liquid deposition apparatus 32 is constituted as a coating apparatus for applying treatment liquid by a roller, which deposits (applies) treatment liquid to the printing surface of the paper P by abutting and pressing a coating roller bearing treatment liquid on the circumferential surface thereof against the surface of the paper P. Apart from this, the treatment liquid deposition apparatus 32 may also be constituted by an inkjet head, a sprayer, or the like. An inkjet method has a merit in enabling selective deposition only onto the ink droplet ejection locations and periphery thereof. By ejecting droplets of ink after previously depositing treatment liquid of this kind, it is possible to suppress landing interference, and high-quality printing can be achieved.

According to the treatment liquid deposition unit 30 having the composition described above, the paper P is conveyed along a prescribed conveyance path by the treatment liquid deposition drum 31. During this conveyance process, treatment liquid is deposited onto the printing surface from the treatment liquid deposition apparatus 32.

The paper P having treatment liquid deposited on the printing surface thereof is then transferred from the treatment liquid deposition drum 31 to the transfer drum 80 at a prescribed position. Thereupon, the paper is conveyed along the prescribed conveyance path by the transfer drum 80 and is transferred onto the conveyance drum 41 of the image recording unit 40.

Here, as described above, the drier 84 is arranged inside the transfer drum 80, and a hot air flow is blown toward the guide plate 83. A hot air flow is blown onto the printing surface of the paper P during the course of the conveyance of the paper from the treatment liquid deposition unit 30 to the image recording unit 40 by the transfer drum 80, thereby drying the treatment liquid which has been deposited on the printing surface (namely, evaporating off the solvent component in the treatment liquid).

Image Recording Unit

The image recording unit 40 ejects ink droplets of the respective colors of C, M, Y and K onto the printing surface of the paper P in order to form a color image on the printing surface of the paper P. The image recording unit 40 includes: a conveyance drum 41 (hereinafter, called "image recording drum") which conveys paper P; a paper pressing roller 42 which presses against the printing surface of the paper P conveyed by the image recording drum 41, thereby causing the rear surface of the paper P to make close contact with the circumferential surface of the image recording drum 41; a paper floating detection sensor 43 which detects floating of the paper P having passed the paper pressing roller 42; inkjet heads 44C, 44M, 44Y and 44K which eject ink droplets of respective colors of C, M, Y and K onto the paper P; and a transparent liquid ejection head 45 which ejects droplets of transparent liquid onto the paper P.

The image recording drum 41 receives paper P from the transfer drum 80 and conveys the paper P by rotating.

The paper pressing roller 42 is disposed in the vicinity of the paper receiving position of the image recording drum 41 (the position where paper P is received from the transfer drum 80), and is abutted and pressed against the circumferential surface of the image recording drum 41 by receiving a pressing force from a pressing mechanism, which is not illustrated. The paper P transferred from the transfer drum 80 to the image recording drum 41 is nipped by passing the paper pressing roller 42 and the rear surface of the paper is thereby caused to make close contact with the outer circumferential surface of the image recording drum 41.

The paper floating detection sensor 43 detects floating of the paper P having passed the paper pressing roller 42 (a prescribed amount or more of floating from the outer circumferential surface of the image recording drum 41). The paper floating detection sensor 43 is constituted by a laser emitter and laser receiver, for example. The laser emitter emits laser light parallel to the axis of the image recording drum 41, from one end of the image recording drum 41 toward the other end thereof, at a position with a prescribed height above the outer circumferential surface of the image recording drum 41. The laser receiver is arranged opposing the laser emitter on the other side of the image recording drum 41, and receives laser light emitted by the laser emitter. If floating up equal to or exceeding a certain amount occurs in the paper P having passed the paper pressing roller 42, then the laser light emitted from the laser emitter is shielded by the paper P and cannot be received by the laser receiver. The paper floating detection sensor 43 detects floating of the paper P by detecting the presence or absence of received laser light in the laser receiver.

The four inkjet heads 44C, 44M, 44Y and 44K are disposed after the paper floating detection sensor 43 and are arranged at uniform intervals along the conveyance path of the paper P. The inkjet heads 44C, 44M, 44Y and 44K are each constituted by a line head corresponding to the paper width and eject ink droplets of the corresponding color ink droplets toward the image recording drum 41 from a nozzle row formed on the nozzle surface.

The transparent liquid ejection head 45 is arranged after the inkjet heads 44C, 44M, 44Y and 44K, and ejects droplets of a prescribed transparent liquid (virtually transparent liquid) onto blank background portions (regions where ink droplets are not deposited) of the paper P on which an image has been formed. Similarly to the inkjet heads 44C, 44M, 44Y and 44K, the transparent liquid ejection head 45 is constituted by a line head corresponding to the paper width and ejects droplets of the transparent liquid toward the image recording drum 41 from a nozzle row formed on the nozzle surface.

According to the image recording unit 40 having the composition described above, the paper P is conveyed along a prescribed conveyance path by the image recording drum 41. The paper P transferred from the transfer drum 80 to the image recording drum 41 is firstly nipped by the paper pressing roller 42 and caused to make close contact with the outer circumferential surface of the image recording drum 41. Thereupon, the presence or absence of floating is detected by the paper floating detection sensor 43, whereupon ink droplets of respective colors of C, M, Y and K are ejected onto the printing surface from the inkjet heads 44C, 44M, 44Y and 44K, thereby forming a color image on the printing surface. When an image has been formed on the paper P, transparent liquid is deposited onto the blank background portions of the paper P by the transparent liquid ejection head 45, and the paper is then transferred to the transfer drum 90 at a prescribed position.

Here, in the inkjet printing apparatus 10 according to the present embodiment, an aqueous ink composed by an ink in which a thermoplastic resin has been dispersed is used for each color.

Even if using an aqueous ink of this kind, in the inkjet printing apparatus 10 according to the present embodiment, since ink droplets are ejected after previously depositing a prescribed treatment liquid (a treatment liquid having a function of aggregating the coloring material in the ink), onto the paper P, then it is possible to suppress landing interference and high-quality printing can be achieved.

Furthermore, by ejecting droplets of transparent liquid onto the blank background portions, it is possible to equalize the amount of moisture in the whole of the paper and local deformation of the paper can be eliminated. A method of depositing transparent liquid onto the blank background portions of the paper P is described in detail below.

The paper P which has been transferred to the transfer drum 90 is conveyed on a prescribed conveyance path by the transfer drum 90, and is transferred onto the conveyance drum 51 of the ink drying unit 50. As described above, the drier 94 is arranged inside the transfer drum 90, and a hot air flow is blown toward the guide plate 93. An ink drying process is carried out in an ink drying unit 50 at a later stage, but the paper P also undergoes a drying process during conveyance by the transfer drum 90.

Ink Drying Unit

The ink drying unit 50 dries the liquid component remaining on the paper P after image recording. This ink drying unit 50 includes a conveyance drum (hereinafter, called "ink drying drum") 51 which conveys the paper P, and an ink drying apparatus 52 which carries out a drying process on the paper P conveyed by the ink drying drum 51.

The ink drying drum 51 receives the paper P from the transfer drum 90 and conveys the paper P by rotating.

The ink drying apparatus 52 is constituted by a drier, for example, and dries the ink (evaporates off the liquid component present on the paper) by blowing a hot air flow (for example 80° C.) toward the paper P conveyed by the ink drying drum 51.

In the ink drying unit 50 having the composition described above, the paper P is conveyed on the ink drying drum 51. During the course of this conveyance, a hot air flow is blown from the ink drying apparatus 52 onto the printing surface and the ink which has been deposited on the printing surface is dried.

The paper P which has passed through the ink drying apparatus 52 is subsequently received onto the transfer drum 100 from the ink drying drum 51 at a prescribed position. The paper P is conveyed on a prescribed conveyance path by the transfer drum 100 and is transferred to the conveyance drum 61 of the fixing unit 60.

As described above, the drier 104 is disposed inside the transfer drum 100 and blows a hot air flow toward the guide plate 103. Consequently, the paper P undergoes a drying process during conveyance on the transfer drum 100.

Fixing Unit

The fixing unit 60 fixes an image which has been recorded on the printing surface, by applying heat and pressure to the paper P. The fixing unit 60 includes a conveyance drum which conveys paper P (hereinafter called "fixing drum") 61, heat rollers 62, 63 which apply a heating and pressurization process to the paper P conveyed by the fixing drum 61, and an in-line sensor 64 which determines the temperature and humidity, and the like, of the paper P after printing and which captures the printed image.

The fixing drum 61 receives the paper P from the transfer drum 100 and conveys the paper P by rotating.

The heat rollers 62, 63 heat and pressurize the ink that has been deposited onto the printing surface of the paper P, thereby melting the thermoplastic resin dispersed in the ink and causing the ink to form a film. Furthermore, deformation such as cockling, curl, and the like, which has occurred in the paper P is also corrected simultaneously with this. The heat rollers 62, 63 are formed to substantially the same width as the fixing drum 61, and are heated to a prescribed temperature by the heaters provided therein. Furthermore, the heat rollers 62 and 63 are abutted and pressed against the circumferential surface of the fixing drum 61 with a prescribed pressing force, by means of a pressurizing device, which is not illustrated. When the paper P passes the heat rollers 62, 63, the paper P is heated and pressurized by the heat rollers 62, 63.

The in-line sensor 64 includes a temperature meter, a humidity meter, and a CCD line sensor, and the like, and determines the temperature and humidity, and the like, of the paper P conveyed by the fixing drum 61, as well as capturing the image printed on the paper P. Apparatus abnormalities and head ejection defects, and the like, are checked on the basis of the determination results of the in-line sensor 64.

According to the fixing unit 60 having the composition described above, the paper P is conveyed by the fixing drum 61, and the heat rollers 62, 63 are abutted and pressed against the printing surface during the course of this conveyance, thereby applying heat and pressure to the paper. By this means, the thermoplastic resin dispersed in the ink is melted and the ink forms a film. Furthermore, simultaneously with this, the deformation which has occurred in the paper P is corrected.

The paper P which has undergone a fixing process is transferred from the fixing drum 61 to the recovery unit 70 at a prescribed position.

Recovery Unit

The recovery unit 70 recovers the paper P which has undergone the series of printing processes, in a stacked fashion in a stacker 71. The recovery unit 70 includes the stacker 71 where the paper P is recovered, and a paper output conveyor 72 which receives paper P that has undergone a fixing process in the fixing unit 60, from the fixing drum 61, conveys the paper P on a prescribed conveyance path, and outputs the paper P to the stacker 71.

The paper P which has undergone a fixing process in the fixing unit 60 is transferred onto the paper output conveyor 72 from the fixing drum 61, conveyed by the paper output conveyor 72 up to the stacker 71, and then recovered in the stacker 71.

Control System

Figure 2:
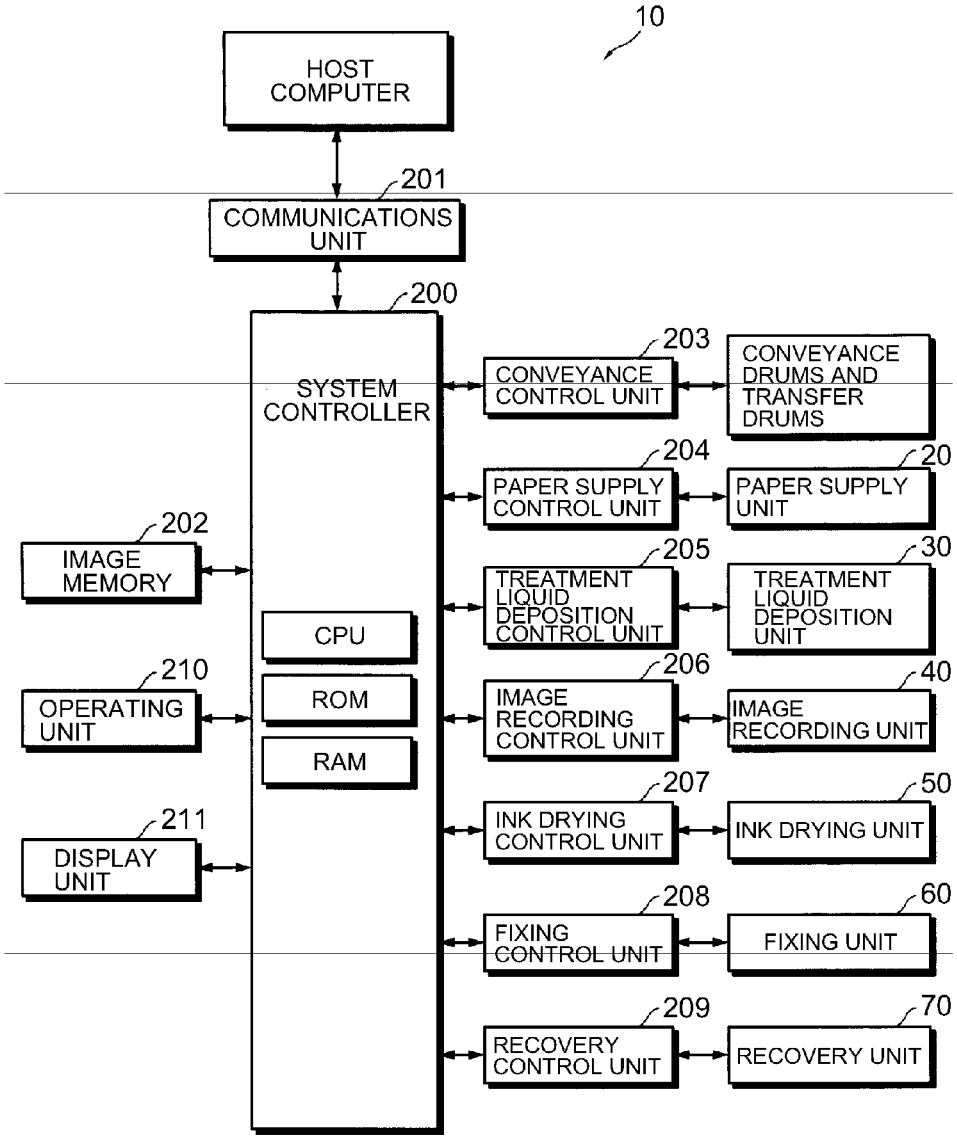
FIG. 2 is a block diagram showing the general composition of a control system of an inkjet printing apparatus.

FIG. 2 is a block diagram showing the approximate composition of a conveyance system of an inkjet recording apparatus 10 according to the present embodiment.

As shown in FIG. 2, the inkjet recording apparatus 10 includes a system controller 200, a communications unit 201, an image memory 202, a conveyance control unit 203, a paper supply control unit 204, a treatment liquid deposition control unit 205, an image recording control unit 206, an ink drying control unit 207, a fixing control unit 208, a recovery control unit 209, an operating unit 210, a display unit 211, and the like.

The system controller 200 functions as a control device which performs overall control of the respective units of the inkjet printing apparatus 10, and also functions as a calculation device which performs various calculation processes. This system controller 200 includes a CPU, ROM, RAM and the like, and operates in accordance with a prescribed control program. Control programs executed by the system controller 200 and various data necessary for control purposes are stored in the ROM.

The communications unit 201 includes a required communications interface, and sends and receives data between the communications interface and a connected host computer.

The image memory 202 functions as a temporary storage device for various data including image data, and data is read from and written to the memory via the system controller 200. Image data which has been read in from a host computer via the communications unit 201 is stored in the image memory 202.

The conveyance control unit 203 controls the driving of the conveyance drums 31, 41, 51, 61, which are conveyance devices of the paper P in the treatment liquid deposition unit 30, the image recording unit 40, the ink drying unit 50 and the fixing unit 60, and the driving of the transfer drums 80, 90, 100.

More specifically, the conveyance control unit 203 controls the driving of the motors which drive the conveyance drums 31, 41, 51, 61, and also controls the opening and closing of the grippers G which are provided on the conveyance drums 31, 41, 51, 61.

Similarly, the conveyance control unit 203 also controls the driving of the motors which drive the transfer drums 80, 90, 100, as well as controlling the opening and closing of the grippers G which are provided in the transfer drums 80, 90, 100.

Furthermore, since a mechanism for suctioning and holding the paper P on the circumferential surface is provided in each of the conveyance drums 31, 41, 51, 61, then the conveyance control unit 203 also controls the driving of the suctioning and holding mechanisms (in the present embodiment, since the paper P is suctioned by vacuum, then the conveyance control unit 203 controls the driving of the vacuum pump which forms a negative pressure generating device).

Moreover, driers 84, 94 and 104 are provided in the transfer drums 80, 90, 100, and therefore the conveyance control unit 203 also controls the driving (amount of heating and air flow volume) of these driers.

The driving of the conveyance drums 31, 41, 51, 61 and the transfer drums 80, 90, 100 is controlled in accordance with instructions from the system controller 200.

The paper supply control unit 204 controls the driving of the respective units which constitute the paper supply unit 20 (e.g. the paper supply apparatus 21, transfer drum 23, and the like), in accordance with instructions from the system controller 200.

The treatment liquid deposition control unit 205 controls the driving of the respective units (for example, the treatment liquid deposition apparatus 32) which constitute the treatment liquid deposition unit 30, in accordance with instructions from the system controller 200.

The image recording control unit 206 controls the driving of the respective units which constitute the image recording unit 40 (the paper pressing roller 42, inkjet heads 44C, 44M, 44Y and 44K, and the transparent liquid ejection head 45, and the like) in accordance with instructions from the system controller 200.

The ink drying control unit 207 controls the driving of the respective units which constitute the ink drying unit 50 (the ink drying apparatus 52, and the like), in accordance with instructions from the system controller 200.

The fixing control unit 208 controls the driving of the respective units which constitute the fixing unit 60 (the heat rollers 62, 63, the in-line sensor 64, and the like), in accordance with instructions from the system controller 200.

The recovery control unit 209 controls the driving of the respective units (for example, the paper output conveyor 72) which constitute the recovery unit 70, in accordance with instructions from the system controller 200.

The operating unit 210 includes a required operating device (for example, operating buttons, a keyboard, a touch panel, or the like), and outputs operational information input via the operating device to the system controller 200. The system controller 200 executes various processing in accordance with the operational information input from the operating unit 210.

The display unit 211 includes a required display apparatus (for example, an LCD panel, or the like), and causes required information to be displayed on the display apparatus in accordance with instructions from the system controller 200.

As described above, image data to be recorded on the paper is read into the inkjet recording apparatus 10 from the host computer via the communications unit 201 and is stored in the image memory 202. The system controller 200 generates dot data by carrying out required signal processing on the image data stored in the image memory 202, and records an image represented by this image data by controlling the driving of the inkjet heads of the image recording unit 40 in accordance with the generated dot data.

In general, the dot data is generated by subjecting the image data to color conversion processing and halftone processing. The color conversion processing is processing for converting image data represented by sRGB, or the like (for example, RGB 8-bit image data) into ink volume data for respective colors of ink used by the inkjet printing apparatus 10 (in the present embodiment, ink volume data for the respective colors of C, M, Y and K). The halftone processing is processing for converting the ink volume data of the respective colors generated by the color conversion processing into dot data of respective colors by error diffusion processing, or the like.

The system controller 200 generates dot data of the respective colors by applying color conversion processing and halftone processing to the image data. An image represented by the image data is recorded on the paper by controlling the driving of the corresponding inkjet heads in accordance with the dot data for the respective colors thus generated.

Printing Operation

Next, a printing operation of the inkjet printing apparatus 10 described above will be explained.

When the system controller 200 outputs a paper supply instruction to the paper supply apparatus 21, paper P is supplied from the paper supply apparatus 21 to the paper supply tray 22. The paper P supplied to the paper supply tray 22 is transferred to the treatment liquid deposition drum 31 of the treatment liquid deposition unit 30 via the transfer drum 23.

The paper P transferred onto the treatment liquid deposition drum 31 is conveyed along a prescribed conveyance path by the treatment liquid deposition drum 31, and during the course of this conveyance, the paper passes through the treatment liquid deposition apparatus 32 and treatment liquid is deposited on the printing surface of the paper.

The paper P on which treatment liquid has been deposited is transferred from the treatment liquid deposition drum 31 to the transfer drum 80, conveyed on a prescribed conveyance path by the transfer drum 80, and then transferred to the image recording drum 41 of the image recording unit 40. During the course of conveyance by the transfer drum 80, a hot air flow is blown onto the printing surface from the drier 84 which is disposed inside the transfer drum 80, and the treatment liquid which has been deposited on the printing surface is dried.

The paper P transferred from the transfer drum 80 to the image recording drum 41, firstly, passes the paper pressing roller 42 and is nipped by the paper pressing roller 42, thereby causing the paper to make close contact with the outer circumferential surface of the image recording drum 41. Thereupon, the paper passes the inkjet heads 44C, 44M, 44Y and 44K, ink droplets of the respective colors of C, M, Y and K are ejected from the inkjet heads 44C, 44M, 44Y and 44K, and a color image is thereby formed on the printing surface. The paper P on which an image has been formed subsequently receives deposition of transparent liquid on the blank background portions thereof, thereby equalizing the amount of moisture in the whole sheet of paper, whereupon the paper is transferred from the image recording drum 41 to the transfer drum 90.

The paper P which has been transferred to the transfer drum 90 is conveyed on a prescribed conveyance path by the transfer drum 90, and is transferred onto the ink drying drum 51 of the ink drying unit 50. During the course of this conveyance, a hot air flow is blown onto the printing surface from the drier 94 which is disposed inside the transfer drum 90, and the ink which has been deposited on the printing surface is dried.

The paper P which has been transferred to the ink drying drum 51 is conveyed along a prescribed conveyance path by the ink drying drum 51, and in the course of this conveyance, a hot air flow is blown onto the printing surface from the ink drying apparatus 52, thereby drying the liquid component remaining on the printing surface.

The paper P which has undergone the drying process is transferred from the ink drying drum 51 to the transfer drum 100, conveyed along a prescribed conveyance path, and transferred to the fixing drum 61 of the fixing unit 60. During the course of conveyance by the transfer drum 100, a hot air flow is blown onto the printing surface from the drier 104 which is disposed inside the transfer drum 100, thereby further drying the ink which has been deposited on the printing surface.

The paper P which has been transferred to the fixing drum 61 is conveyed along a prescribed conveyance path by the fixing drum 61, and during the course of this conveyance is heated and pressurized by the heat rollers 62 and 63, thereby fixing the image formed on the printing surface. The paper P is then transferred onto the paper output conveyor 72 of the recovery unit 70 from the fixing drum 61, conveyed by the paper output conveyor 72 up to the stacker 71, and then output into the stacker 71.

As described above, in the inkjet printing apparatus 10 according to the present embodiment, the paper P is conveyed on drums and during the course of this conveyance, respective processes of treatment liquid deposition and drying, ejection of ink droplets, ejection of droplets of transparent liquid, drying, and fixing are carried out on the paper P, thereby recording a prescribed image on the paper P.

Details of Method of Depositing Transparent Liquid

As described above, in the inkjet printing apparatus 10 according to the present embodiment, the amount of moisture in the paper P is equalized by ejecting droplets of transparent liquid onto the blank background portions of the paper P in the image recording unit 40, thereby preventing local deformation of the paper P.

The deformation of the paper P which occurs when ink has been deposited varies with the printing conditions, and if transparent liquid is deposited under the same conditions, then it may happen that more transparent liquid than necessary is deposited. Furthermore, deformation of the paper gives rise to decline in print quality, but in addition to this there is also a possibility that the paper cannot be conveyed correctly during the rear surface printing.

Therefore, in the inkjet printing apparatus 10 according to the present embodiment, the volume of transparent liquid deposited is adjusted in accordance with the printing conditions, so that the transparent liquid is deposited in an appropriate fashion.

Below, a method of depositing transparent liquid in accordance with the printing conditions is described.

First Embodiment

The deformation of the paper occurring when ink has been deposited varies with the paper used. For example, deformation is less liable to occur in thick paper than in thin paper. Furthermore, in the case of coated paper having a coating layer, the permeation of the solvent is slower than in normal paper which does not have a coating layer, and the solvent can be dried in the ink drying unit 50 before deformation progresses significantly. Therefore, it is possible to deposit transparent liquid appropriately onto the paper by using this kind of information about the paper.

Figures 3, 4, 5, 6:
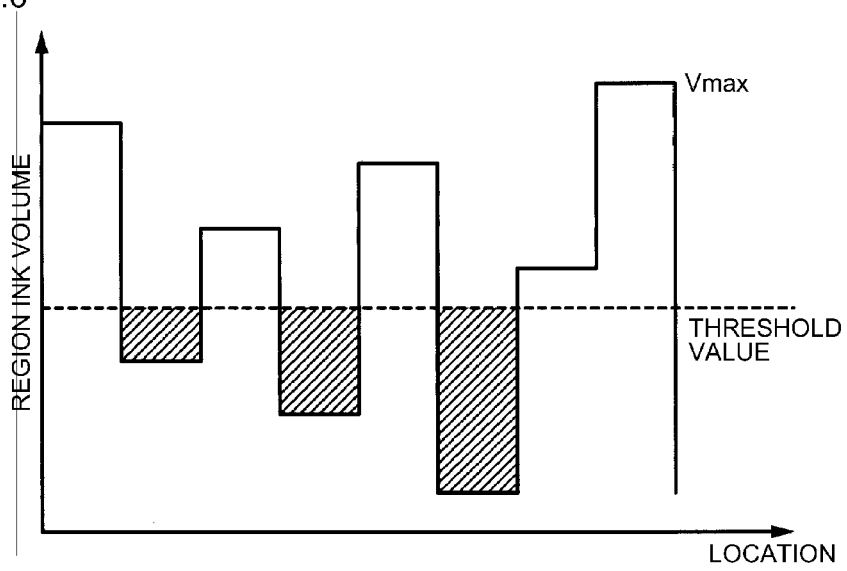
FIG. 3 is a table showing the relationship between the paper thickness and paper type, and the transparent liquid deposition volume.
FIG. 4 is a table showing the relationship between the presence or absence of rear surface printing, and the deposition volume of transparent liquid.
FIG. 5 is a table showing the relationship between the printing speed and the deposition volume of transparent liquid.
FIG. 6 is a conceptual diagram of a method of depositing transparent liquid according to a fourth embodiment.

FIG. 3 is a table showing the relationship between the paper thickness and paper type, and the deposition volume of transparent liquid.

As stated above, deformation is less liable to occur in thick paper than in thin paper. Therefore, in the case of thick paper, the volume of transparent liquid deposited can be made smaller than in the case of thin paper. Experimentation confirmed that substantial deformation of the paper did not occur when the thickness of the paper exceeded 150 gsm (Gram per Square Meter). Therefore, as shown in the table in FIG. 3, if the paper thickness is 150 gsm or greater, then the deposition volume of transparent liquid is set to zero (no transparent liquid is deposited), regardless of the type of paper.

Furthermore, as stated above, in the case of coated paper having a coating layer, the permeation of the solvent is slow and the solvent can be dried in the ink drying unit 50 before deformation of the paper progresses significantly. Consequently, in the case of coated paper having a coating layer, the volume of transparent liquid is reduced in comparison with normal paper which does not have a coating layer. More specifically, as shown by the table in FIG. 3, if the paper thickness is less than 150 gsm, then taking the rate for normal paper to be 1, the rate for coated paper is set to 0.5. The numerical value 1 given here is the amount of liquid in the case of maximum droplet ejection in the inkjet printing apparatus 10 according to the present embodiment.

The information in the table shown in FIG. 3 is stored in the form of a look-up table (LUT) in the ROM provided in the system controller 200, for example. A user inputs information about the paper from the operating unit 210. The system controller 200 refers to the LUT stored in the ROM and decides the deposition volume of transparent liquid to be ejected as droplets onto the blank background portions of the paper, on the basis of the input information.

Rather than being input manually by the user, the paper information can also be assigned to a barcode, or the like, on a paper stack, in such a manner that the barcode can be read in automatically and the necessary information can be acquired.

In this way, it is possible to deposit transparent liquid appropriately, without creating waste, by determining the deposition volume of transparent liquid to be deposited onto the blank background portions of the paper on the basis of the paper information.

In the example described above, the deposition volume is determined on the basis of information relating to both the type of paper and the paper thickness, but it is also possible to decide the deposition volume on the basis of only one of the items of information. Furthermore, it is also possible to decide the deposition volume by using information other than the paper type or paper thickness described above.

Second Embodiment

Deformation of the paper gives rise to decline in print quality, but even if there is slight deformation that does not affect print quality, in the case of an apparatus which conveys paper by suctioning, as in the inkjet printing apparatus 10 according to the present embodiment, there is a possibility that the deformation of the paper accumulates as the paper is progressively suctioned from the leading end thereof, giving rise to wrinkles in the trailing end portion of the paper.

Consequently, if rear surface printing is pending, the deposition volume of the transparent liquid is increased so as to remove local distortion of the paper. On the other hand, if rear surface printing is not pending, (in the case of single side printing or when printing on the rear surface in double-side printing), the volume of the transparent liquid is reduced.

FIG. 4 is a table showing the relationship between the presence or absence of rear surface printing, and the deposition volume of transparent liquid. As shown in the table, if rear surface printing is pending, then the rate is 1, and if rear surface printing is not pending, then the rate is 0.3. Similarly to the foregoing explanation, the numerical value 1 given here is the amount of liquid in the case of maximum droplet ejection in the inkjet printing apparatus 10 according to the present embodiment.

The information in the table shown in FIG. 4 is stored in the form of a look-up table (LUT) in the ROM provided in the system controller 200, for example. A user inputs information about the presence or absence of rear surface printing via the operating unit 210 (if the presence or absence of double-side printing is set automatically, then this setting is followed (employed)). The system controller 200 refers to the LUT stored in the ROM and decides the deposition volume of transparent liquid to be ejected as droplets onto the blank background portions of the paper, on the basis of the input information.

In this way, it is possible to deposit transparent liquid appropriately, without creating waste, by determining the deposition volume of transparent liquid to be deposited onto the blank background portions of the paper on the basis of information indicating the presence or absence of rear surface printing.

Third Embodiment

If the printing speed is fast, then the time T for the paper to be conveyed up to the ink drying unit 50 after ejection of ink droplets becomes short. Therefore, if the time T for the paper to be conveyed up to the ink drying unit 50 becomes short, then the permeation of solvent into the paper is small and it is possible to dry solvent in the ink drying unit 50 before deformation of the paper advances significantly. Consequently, if the printing speed is fast, then it is possible to reduce the volume of transparent liquid that is deposited.

On the other hand, if the printing speed is slow, then the time T from the ejection of ink droplets until the paper has been conveyed to the ink drying unit 50 becomes long. In this case, drying is carried out after the solvent has permeated into the paper, and therefore deformation remains even if the solvent has been dried. Consequently, the deposition volume of the transparent liquid is increased so as to remove local distortion of the paper.

FIG. 5 is a table showing the relationship between the printing speed and the deposition volume of transparent liquid. As shown in the table, the rate is 1 in the case of low-speed printing and 0.3 in the case of high-speed printing. Similarly to the foregoing explanation, the numerical value 1 given here is the amount of liquid in the case of maximum droplet ejection in the inkjet printing apparatus 10 according to the present embodiment.

The information in the table shown in FIG. 5 is stored in the form of a look-up table (LUT) in the ROM provided in the system controller 200, for example. A user inputs information about the printing speed (high-speed/low-speed) via the operating unit 210 (if the printing speed is set automatically, then this setting is followed (employed)). The system controller 200 refers to the LUT stored in the ROM and decides the deposition volume of transparent liquid to be ejected as droplets onto the blank background portions of the paper, on the basis of the input information.

In this way, it is possible to deposit transparent liquid appropriately, without creating waste, by determining the deposition volume of transparent liquid to be deposited onto the blank background portions of the paper on the basis of information about the printing speed (namely, the time T until drying by the ink drying unit).

In the present embodiment, the printing speed is divided into two stages, low speed and high speed, and a transparent liquid deposition volume is set individually for each of them, but by dividing the printing speed into a greater number of stages and setting a transparent liquid deposition volume for each, it is possible to deposit the transparent liquid even more appropriately. Moreover, desirably, the volume of transparent liquid deposited is determined on the basis of experimental results, and the like.

Fourth Embodiment

Local deformation of the paper occurs due to the difference between the portion where ink has been deposited and the portion where ink has not been deposited (the locality of ink deposition). Consequently, it is possible to deposit transparent liquid more appropriately by depositing transparent liquid so as to eliminate this difference. The amount of ink deposited on a corresponding region is determined in accordance with the image to be printed. Therefore, in the present embodiment, the deposition volume of transparent liquid is determined on the basis of information about the image to be printed. More specifically, the deposition volume is determined as follows.

The print area of the paper is divided into a plurality of regions (for example, a plurality of regions based on 50 mm×50 mm segments (i.e. one segment: 50 mm×50 mm)), and the total volume of ink deposited onto each of the respective regions is calculated as a "region ink volume" for each region. The region ink volume for each region thus determined is compared with a threshold value, and transparent liquid is deposited only onto regions where the region ink volume is smaller than the threshold value. In this case, the transparent liquid of an amount corresponding to the difference with respect to threshold value is deposited.

FIG. 6 is a conceptual diagram of a method of depositing transparent liquid according to the fourth embodiment. As shown in FIG. 6, the region ink volume and the threshold value are compared in each region, and in regions where the region ink volume is smaller than the threshold value, transparent liquid of an amount corresponding to the difference with respect to the threshold value (the hatched portion in FIG. 6) is deposited.

By depositing transparent liquid in this way, it is possible to eliminate difference between the portions where ink has been deposited and the portions where ink has not been deposited, and the amount of moisture in the whole sheet of paper can be equalized.

In the present embodiment, the deposition volume of the transparent liquid which is deposited on a region where the region ink volume is lower than a threshold value is set to be the difference with respect to the threshold value, but the deposition volume does not have to be set to this difference and may be based on another parameter.

Furthermore, the threshold value which is compared with the region ink volume can be set from various viewpoints, but desirably is set on the basis of the maximum value of the region ink volumes (Vmax). In other words, a desirable composition is one where the threshold value is varied in accordance with the maximum value (Vmax) of the region ink volumes. FIG. 7 is a table showing the relationship between the threshold value and the maximum value (Vmax) of the region ink volumes in a case where the threshold value is varied in accordance with the maximum value (Vmax) of the region ink volumes. In the example shown in FIG. 7, the threshold value is set to 0 when the maximum value (Vmax) of the region ink volumes is Vmax≤0.4. More specifically, the threshold value is set in such a manner that transparent liquid is not deposited when the maximum value (Vmax) of the region ink volumes is Vmax≤0.4. Furthermore, if the maximum value (Vmax) of the region ink volumes is 0.4<Vmax 23 0.6, then the threshold value is set to 0.25. More specifically, the threshold value is set in such a manner that transparent liquid is deposited onto only regions having a region ink volume of 0.25 or less. Furthermore, if the maximum value (Vmax) of the region ink volumes is 0.6<Vmax≤0.8, then the threshold value is set to 0.35. More specifically, the threshold value is set in such a manner that transparent liquid is deposited onto only regions having a region ink volume of 0.35 or less. Furthermore, if the maximum value (Vmax) of the region ink volumes is 0.8<Vmax≤1.0, then the threshold value is set to 0.45. More specifically, the threshold value is set in such a manner that transparent liquid is deposited onto only regions having a region ink volume of 0.45 or less.

The respective numerical values given here are the ink volume when the maximum droplet ejection of the inkjet printing apparatus 10 according to the present embodiment is deposited onto the whole of the region.

By varying the threshold value in accordance with the maximum value (Vmax) of the region ink volumes in this way, it is possible to deposit the transparent liquid more appropriately.

The system controller 200 calculates the region ink volume of each region on the basis of the ink volume data generated in the course of generating dot data from the image data. The threshold value is specified by determining the maximum value (Vmax) from the region ink volumes of each region thus obtained (if the threshold value is variable). The specified threshold value is then compared with the region ink volume of each region, and the transparent liquid deposition volumes for each region are set.

The relationship between the maximum value (Vmax) of the region ink volumes and the threshold value is stored in the form of a look-up table (LUT), for example, in the ROM provided in the system controller 200. The system controller 200 specifies the threshold value by referring to the LUT.

In the example described above, a composition is adopted in which the region ink volume of each region is calculated on the basis of ink volume data obtained by color conversion processing of image data (RGB data), but the region ink volumes of respective regions may also be determined on the basis of the image data (RGB data) or the dot data (CMYK dot data).

Other Embodiments

In the first to fourth embodiments described above, cases are described where respective methods are used independently, namely (1) a method where the transparent liquid deposition volume to be deposited on blank background portions is determined on the basis of information about the paper, (2) a method where the transparent liquid deposition volume to be deposited on blank background portions is determined on the basis of information about the presence or absence of rear surface printing, (3) a method where the transparent liquid deposition volume to be deposited on blank background portions is determined on the basis of information about the printing speed, and (4) a method where the transparent liquid deposition volume to be deposited on blank background portions is determined on the basis of information about the image to be printed; however, these respective methods may also be used in combination as appropriate. For example, it is also possible to determined the deposition volume on the basis of information about the paper and information about the presence or absence of rear surface printing, and it is also possible to determine the deposition volume on the basis of information about the paper, information about the presence or absence of rear surface printing and information about the printing speed. By this means, it is possible to set the transparent liquid deposition volume even more appropriately.

In this case, for example, a look-up table specifying a relationship between input information and the corresponding deposition volume is created and stored in the ROM provided in the system controller 200. A user inputs required information via the operating unit 210 (if the required information is set automatically, then this setting is followed (employed)). The system controller 200 refers to the LUT stored in the ROM and determines the deposition volume of transparent liquid to be ejected as droplets onto the blank background portions of the paper, on the basis of the input information.

Transparent Liquid Used

Desirably, the components of the transparent liquid are (1) water and a high-boiling-point organic solvent having a higher polarity than the high-boiling-point organic solvent in the ink (in other words, a solvent having a high solubility parameter (SP value)). By this means, it is possible to spread the liquid over the paper by depositing a smaller amount.

Furthermore, desirably, (2) the surface tension of the transparent liquid is smaller than the surface tension of the ink, and (3) the viscosity of the transparent liquid is lower than the viscosity of the ink. By this means, the transparent liquid can permeate into the paper more rapidly than the ink and as a result of this can be spread over the paper using a smaller volume. Furthermore, the resolution of the transparent liquid ejection head may be lower than that of the inkjet head.

Moreover, desirably, the transparent liquid includes a small volume of material which absorbs light other than visible light. By this means, it is possible, for example, to detect whether or not deposition of the transparent liquid has been performed correctly, by means of the in-line sensor 64 provided in the fixing unit 60.

Transparent Liquid Deposition Device

In the embodiment described above, a composition is adopted in which transparent liquid is deposited onto the paper P by means of a transparent liquid ejection head 45 which is provided in the image recording unit 40, but the device for depositing transparent liquid on the paper P is not limited to this. It is possible to use another device to deposit the transparent liquid, provided that it is capable of depositing the transparent liquid at a desired deposition volume onto the blank background portions.

Furthermore, in the embodiment described above, a composition is adopted in which a transparent liquid deposition device (transparent liquid ejection head 45) is arranged after the inkjet heads 44C, 44M, 44Y and 44K, but the arrangement position is not limited to this. For example, it is also possible to arrange the transparent liquid deposition device before the inkjet heads 44C, 44M, 44Y and 44K.

Moreover, in the embodiment described above, a composition is adopted in which a treatment liquid and a transparent liquid are deposited separately, but it is also possible to adopt a composition in which the treatment liquid also serves as a transparent liquid. For example, a possible composition is one where the treatment liquid is deposited by an ejection head (a head similar to an inkjet head), and treatment liquid is deposited onto the blank background portions by using the respective methods described above.

Paper Conveyance Device

In the embodiment described above, a case is given where the paper P is conveyed on drums, but the devices for conveying the paper P are not limited to this. In particular, the present invention has beneficial effects in a case where paper is conveyed on a belt, since the paper is conveyed while suctioning the rear surface, similarly to a drum.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet printing apparatus comprising:

a conveyance device which conveys paper by suctioning, the conveyance device conveying the paper by suctioning the paper from leading end thereof;

an inkjet head which ejects droplets of colored ink onto the paper conveyed by the conveyance device so as to form an image on the paper;

a transparent liquid deposition device which deposits a transparent liquid only onto a blank background portion of the paper conveyed by the conveyance device, the blank background portion being a region where the colored ink is not ejected;

a transparent liquid deposition volume determination device which determines deposition volume of the transparent liquid to be deposited onto the paper based on information indicating whether rear-side printing to the paper is carried out or not; and a transparent liquid deposition control device which controls the transparent liquid deposition device in such a manner that the transparent liquid with the deposition volume determined by the transparent liquid deposition volume determination device is deposited onto the blank background portion of the paper, wherein the information indicates that front-side printing in carrying out double-side printing is regarded as printing only to single side in a case that rear-side printing is to be carried out, and that rear-side printing in carrying out double-side printing is regarded as printing in a case that rear-side printing is not to be carried out, and wherein the transparent liquid deposition volume determination device sets a maximum deposition volume of the transparent liquid by the transparent liquid deposition device for the case that the rear side printing is to be carried out, and sets deposition volume of the transparent liquid, less than the deposition volume of the transparent liquid for the case that the rear side printing is to be carried out, by a predetermined amount, for the case that the rear-side printing is not to be carried out.

2. The inkjet printing apparatus according as defined in claim 1, wherein the conveyance device conveys the paper by suctioning the paper to a rotating circumferential surface.

3. The inkjet printing apparatus as defined in claim 1, wherein:

each of the transparent liquid and the colored ink includes at least water and an organic solvent as a component; and SP1>SP2 is established, where SP1 represents a solubility parameter of the organic solvent in the transparent liquid and SP2 represents a solubility parameter of the organic solvent in the colored ink.

4. The inkjet printing apparatus as defined in claim 1, wherein $\gamma 1 < \gamma 2$ is established, where $\gamma 1$ represents a surface tension of the transparent liquid and $\gamma 2$ represents a surface tension of the colored ink.

5. The inkjet printing apparatus as defined in claim 1, $\eta 1 < \eta 2$ is established, where $\eta 1$ represents viscosity of the transparent liquid and $\eta 2$ represents viscosity of the colored ink.

6. An inkjet printing method of printing an image, comprising the steps of:

conveying paper by suctioning the paper from leading end thereof, by a conveyance device which conveys the paper by suctioning;

printing an image by depositing droplets of colored ink by an inkjet head onto the paper conveyed by the conveyance device so as to form the image on the paper, and by depositing transparent liquid by a transparent liquid deposition device only onto a blank background portion of the paper where the colored ink is not ejected; and determining deposition volume of the transparent liquid to be deposited onto the paper based on information indicating whether rear-side printing to the paper is carried out or not, wherein in the step of determining deposition volume, deposition volume of the transparent liquid to be deposited onto the paper is determined based on information indicating whether rear-side printing to the paper is carried out or not, wherein the information indicates that front-side printing in carrying out double-side printing is regarded as printing only to single side in a case that rear-side printing is to be carried out, and that rear-side printing in carrying out double-side printing is regarded as printing in a case that rear-side printing is not to be carried out, and a maximum deposition volume of the transparent liquid by the transparent liquid deposition device is set for the case that the rear side printing is to be carried out, and deposition volume of the transparent liquid, less than the deposition volume of the transparent liquid for the case that the rear side printing is to be carried out, by a predetermined amount, is set for the case that the rear-side printing is not to be carried out.

7. The inkjet printing method as defined in claim 6, wherein the conveyance device conveys the paper by suctioning the paper to a rotating circumferential surface.

8. The inkjet printing method as defined in claim 6, wherein:

each of the transparent liquid and the colored ink includes at least water and an organic solvent as a component; and SP1>SP2 is established, where SP1 represents a solubility parameter of the organic solvent in the transparent liquid and SP2 represents a solubility parameter of the organic solvent in the colored ink.

9. The inkjet printing method as defined in claim 6, wherein $\gamma 1<\gamma 2$ is established, where $\gamma 1$ represents a surface tension of the transparent liquid and $\gamma 2$ represents a surface tension of the colored ink.

10. The inkjet printing method as defined in claim 6, wherein $\eta 1<\eta 2$ is established, where $\eta 1$ represents viscosity of the transparent liquid and $\eta 2$ represents viscosity of the colored ink.

* * * * *